United States Patent [19]

Blackburn

[11] 4,089,628

[45] May 16, 1978

[54] PULVERIZED COAL ARC HEATED IGNITER SYSTEM

[75] Inventor: Philip Richard Blackburn, West Redding, Conn.

[73] Assignee: Union Carbide Corporation, New York, N.Y.

[21] Appl. No.: 658,741

[22] Filed: Feb. 17, 1976

[51] Int. Cl.[2] ..... F23N 5/00; F23M 3/00

[52] U.S. Cl. ..... 431/6; 110/347

[58] Field of Search ..... 431/9, 183, 6; 219/121 P, 75; 110/28 A, 28 B, 28 C, 28 D, 28 E, 22 A

[56] References Cited

U.S. PATENT DOCUMENTS

| | | | |
|---|---|---|---|
| 1,726,870 | 9/1929 | Trent | 110/22 A |
| 3,049,085 | 8/1962 | Musat et al. | 431/183 |
| 3,294,952 | 12/1966 | Eschenbach | 219/121 P |

FOREIGN PATENT DOCUMENTS

| | | | |
|---|---|---|---|
| 1,395,005 | 5/1975 | United Kingdom. | |
| 775,730 | 5/1957 | United Kingdom | 110/28 B |

OTHER PUBLICATIONS

The Combustion of Pulverized Coal in a Water-Cooled Radiant Tube, Sherman et al. ASME paper No. 52--A-123 Dec. 1952.

*Primary Examiner*—Edward G. Favors
*Assistant Examiner*—Larry Jones
*Attorney, Agent, or Firm*—John R. Doherty

[57] ABSTRACT

An electric arc heated, high velocity, oxidizing gas jet is used to ignite pulverized coal as the coal is fed in an air stream through the coal burners in a conventional coal-fired, suspension type steam boiler.

4 Claims, 3 Drawing Figures

PULVERIZED COAL ARC HEATED IGNITER SYSTEM

The present invention relates to an improved method and apparatus for igniting pulverized coal suspended in an air stream. More particularly, the present invention relates to the use of electric arc heating devices for igniting pulverized coal in a conventional coal-fired, suspension type steam boiler.

BACKGROUND OF THE INVENTION

The majority of power plants that have been installed during the last several decades have been the type which employ a natural gas- or oil-fired steam boiler. Conventional coal-fired boiler plants have become more or less obsolete during this period since both natural gas and oil fuels have been more convenient to use than coal. However, the cost of natural gas and oil has steadily increased in the last several years. Additionally, there is a serious shortage of these fuels in most countries throughout the world. Coal, on the other hand, is still an abundantly available fuel and its cost is moderately low. Consequently, coal-fired steam boiler plants that are in operation today constitute an important part of industry's base line power generation capacity.

In the operation of a conventional coal-fired, suspension type steam boiler, pulverized coal is suspended in an air stream and is fed through conduits to a multiplicity of coal burners in the steam boiler. Upon emerging from the burners the coal is usually mixed with additional air and is ignited. Current practice is to ignite the pulverized coal by means of natural gas or oil fired igniters.

It is contemplated that in future years coal-fired steam boiler plants will be used in conjunction with nuclear plants for generating electricity during times of peak demand. In these installations, the coal-fired steam boilers can be operated under so called "turn-down" conditions, i.e. operation at less than about 70% of design point power. Under these conditions, the pulverized coal that is fed to the coal burners tends to flow intermittently from the burner nozzle causing the coal-air flame to be extinguished between slugs of coal. Combustion instabilities can be created if the flame is not immediately reignited. Moreover, any coal that is not ignited may be swept into hidden recesses in the boiler where the coal can create an explosion hazard. It may therefore be necessary to continuously operate the natural gas or oil fired igniters so as to reignite and stabilize the flame during periods when the coal-air flame might be extinguished.

Depending on the particular size of the steam boiler, there may be anywhere from twelve to forty-eight coal burners employed. Each coal burner may typically range in size from around 20 megawatts per burner to as high as 50 megawatts. Since the natural gas- or oil-fired igniters commonly have thermal ratings which may range from between about 2% and 20% of the thermal rating of the main burners, it will be seen that the operation of these igniters on a continuous basis can be very expensive. Moreover, they will become even more expensive to operate as the cost of liquid and gaseous hydrocarbon fuels escalates in future years.

SUMMARY OF THE INVENTION

An object of the present invention is therefore to provide an improved method and apparatus for igniting a pulverized coal suspended in an air stream.

More specifically, another object of the present invention is to provide an improved method and apparatus for igniting a pulverized coal as the coal is fed in an air stream through the coal burners in a conventional coal-fired, suspension type steam boiler.

Still another object of the present invention is to provide an improved method and apparatus of the type described which do not require the consumption of costly hydrocarbon fuels.

A further object of the present invention is to provide an improved method and apparatus of the type described which use electricity as the main source of power.

A still further object of the present invention is to provide an improved coal ignition system wherein the total energy that is required to ignite the coal is substantially reduced by using hot oxidizing gases such as air and/or oxygen rather than hot combustion products which are the result of igniting with hydrocarbon fuels.

The essence of the present invention resides in the use of an electric arc heated, high velocity, oxidizing gas jet to ignite pulverized coal suspended in an air stream.

Electric arc heating devices are capable of heating a gas to extremely high temperatures. Devices of this type which are commonly referred to as "vortex stabilized arc heating devices" are used in the practice of the present invention. Such devices generally comprise a chamber having means for introducing a gas under pressure tangentially into the chamber so as to produce a stabilizing vortex flow of gas through the device. These devices further include a pair of electrodes for establishing an electric arc in the chamber for heating the gas, means for magnetically controlling the length and direction of the arc and an exit nozzle communicating with the chamber.

Gas that is introduced inside the chamber is heated by the arc to extremely high temperatures whereupon the heated gas exits through the nozzle to the ambient atmosphere in the form of an extremely hot, high velocity gas jet effluent.

In the practice of the present invention, the igniter gas may be any oxidizing, non-combustible gas or gaseous mixture which will support the spontaneous combustion of pulverized coal at high temperatures. Suitable igniter gases include air, straight oxygen and oxygen-enriched air as well as oxidizing gaseous mixtures such as air and/or oxygen together with certain other non-combustible or inert gases such as nitrogen, argon and helium. Specifically excluded from the practice of the present invention are gaseous mixtures including combustible hydrocarbon gases or solids.

The method of the present invention is carried out by directing the electric arc heated, high velocity igniter gas jet into contact with the pulverized coal-air stream until ignition of the pulverized coal occurs through spontaneous combustion. Optionally the igniter gas jet is maintained in contact with the pulverized coal-air stream in order to stabilize the coal-air flame and prevent the flame from being extinguished.

Further in accordance with the present invention, there is provided a coal burner apparatus which comprises a combustion chamber, means for continuously passing the pulverized coal-air stream into the combustion chamber and an electric arc heating device for producing a hot high velocity igniter gas jet for igniting the pulverized coal in the combustion chamber.

The electric arc heating device used in the apparatus of the present invention is the vortex stabilized type which possesses certain significant advantages over other types of arc heating devices in the prior art.

DESCRIPTION OF THE PREFERRED EMBODIMENTS

Coal that is delivered to a typical electric power plant facility arrives in rather large chunk sizes direct from the mine. The coal is crushed and lifted by conveyors to storage bunkers high in the power plant facility. The coal in these bunkers is then fed by gravity to a pulverizing mill which grinds the coal to a very fine particle size. i.e. beteen about 50 and 200 mesh. This finely-pulverized coal is then fed to a conduit where it is suspended in a stream of air. The velocity of the air stream is usually about 100 feet per second. The pulverized coal-air stream is then directed through conduits to the multiplicity of coal burners that are employed in the steam boiler.

Figure 1:
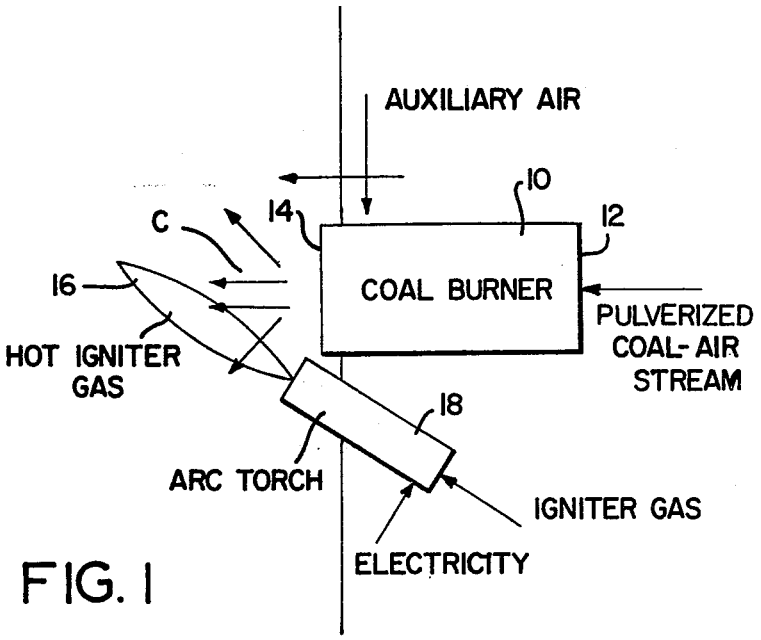
FIG. 1 is a schematic representation of the method of the present invention.

FIG. 1 schematically shows the method of igniting the pulverized coal as it passes through the coal burners in accordance with the present invention. As shown, the pulverized coal-air stream enters the burner 10 at its inlet end 12 and emerges from the burner nozzle (not shown) into a combustion zone C just ahead of the burner outlet end 14. Preferably, although not necessarily, the pulverized coal-air stream emerges from the burner nozzle in a widely dispersed pattern as generally indicated by the arrows in the drawing. Diverting the pulverized coal-air stream in this manner tends to more readily promote ignition of the coal as it emerges from the burner. Suitable means may be employed in the burner outlet end 14 for dispersing the pulverized coal-air stream as shall be explained in greater detail hereinafter.

An auxiliary air stream passes around the burner outlet end 14 and mixes with the pulverized coal-air stream in the combustion zone C as also generally indicated by the arrows in the drawing. The auxiliary air stream may be ambient air or pre-heated air from the steam boiler. If the air is preheated, the auxiliary air stream serves to further promote ignition of the coal by elevating the temperature of the pulverized coal-air stream. The coal is ignited by contacting the pulverized coal-air stream in the combustion zone C with the hot high velocity igniter gas jet effluent 16 which is emitted from the electric arc heating device 18. The arc heating device 18 is placed in close proximity to the outlet end 14 of the burner 10.

Figure 2:
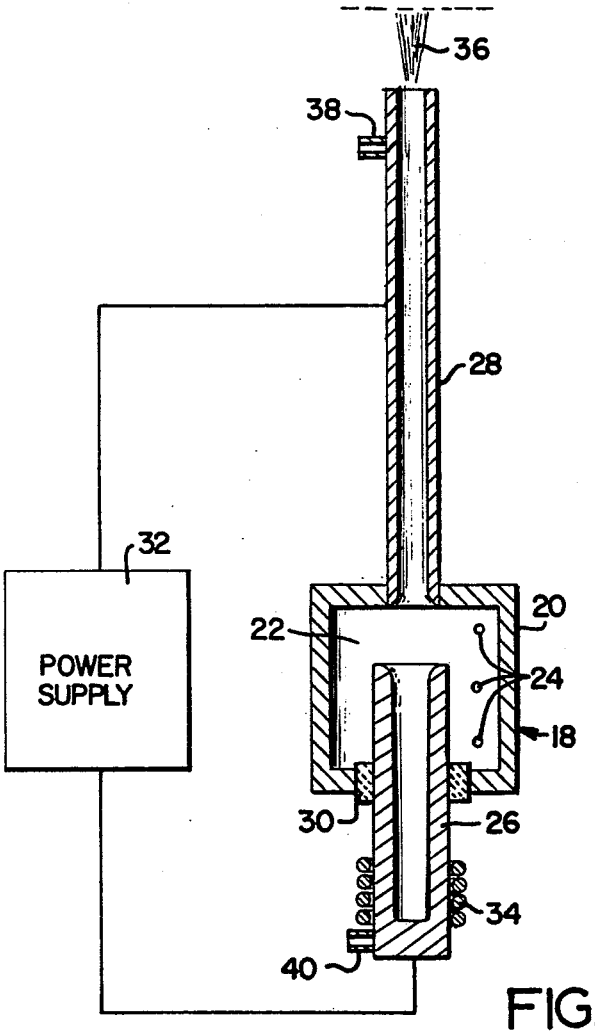
FIG. 2 is an elevational view in section of a typical electric arc heating device for use in the present invention.

The electric arc heating device 18 is the vortex stabilized type shown in detail in FIG. 2. Basically it comprises a hollow cylindrical metallic torch body 20 having therein a central chamber 22 to which a gas may be fed under pressure through a plurality of gas inlet apertures 14. A pair of tubular, non-consumable metal electrodes 26, 28 are mounted to the torch body 20. The tubular electrodes 26, 28 may be composed of copper or copper alloy, for example. The upstream electrode 26 is mounted partly inside the central chamber 22 and is electrically insulated from the torch body 20 by a non-conductive insulating bushing 30. The nozzle or downstream electrode 28 communicates at one end with the central chamber 22. This electrode may or may not have a constricting nozzle (not shown) at its outermost end. A high voltage power supply 32 is connected in series across both electrodes 26, 28.

An igniter gas such as air or oxygen is fed under pressure, say about 20–100 psig, into the central chamber 22 through the plurality of gas inlets 24 which are arranged such that gas flows tangentially into the chamber 22 creating a stabilizing vortex flow of gas within the device. An electric arc is then established from the power supply 32 between the upstream electrode 26 and the downstream electrode 28. The tangential flow of gas through the central chamber 22 tends to direct the arc along the center line of the device, the arc terminating on the upstream electrode 26 and the downstream electrode 28. A magnetic field is induced around the arc by energizing a field coil 34 surrounding the outer end of the upstream electrode 26, the magnetic field positioning and rotating the arc termination on the upstream electrode 26. The gas as it enters the chamber 22 is heated by the arc to extremely high temperatures and passes out through the downstream electrode 28 in the form of a hot high velocity igniter gas jet 36.

Due to the extremely high temperatures encountered, a coolant such as water is circulated through the electric arc heating device 18. Coolant circulation is necessary during operation of the device and also when the device is installed in a hot section of the power plant boiler such as in the wind box which distributes the preheated auxiliary air. Coolant enters the downstream electrode 28 via coolant inlet 38 passing through a series of passageways (not shown) in the electrode 28, torch body 20 and upstream electrode 26. The coolant then exits via the coolant outlet 40 at the upstream electrode 26. Suitable means are also provided for passing a coolant through the field coil 34 which is also heated during operation.

A more detailed explanation of electric arc heating devices of the type described may be found in U.S. Pat. No. 3,301,995 entitled "Electric Arc Heating and Acceleration of Gases," issued on Jan. 31, 1967 to R. C. Eschenbach et al. Electric arc heating devices of this type are capable of producing gas jet effluent temperatures within the range of from about 5,200° to 15,000° F.

By comparison, natural gas- or oil-fired igniters produce hydrocarbon flame temperatures within the more limited range of between about 3,500° to 5,200° F.

Since the onset of ignition of the pulverized coal responds to increased temperatures in an exponential fashion, it will be evident that the use of electric arc heating devices to ignite the coal represents a significant improvement over the prior art.

Aside from high ignition temperatures, there are other advantages in using electric are heating devices to ignite the coal in accordance with the present invention. The hot gas jet effluent from electric arc heating devices using air as the igniter gas consists mainly of hot oxygen and nitrogen or hot oxygen alone when oxygen is used as the igniter gas. There are no combustion products which are chemically inert and which must be thoroughly intermixed with the pulverized coal-air stream before spontaneous combustion of the coal can take place. Moreover, the arc heated gas jet effluent contains both ionized and dissociated species of the igniter gas which are highly chemically active and therefore contribute significantly to the ignition process.

Figure 3:
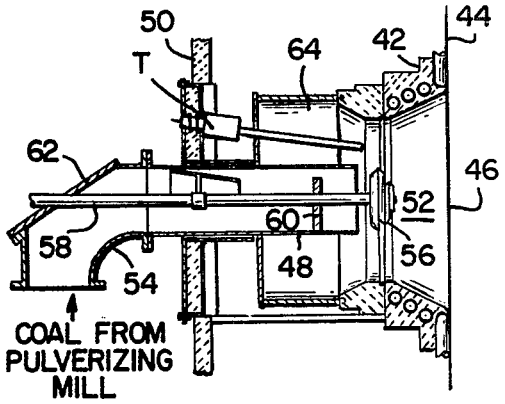
FIG. 3 is an elevational view in section of the coal burner apparatus of the present invention.

Referring now to FIG. 3, there is illustrated one type of coal burner apparatus incorporating the features of the present invention. The coal burner illustrated is of the circular type for use in so-called "target fired" steam boilers. As illustrated, the coal burner includes a housing 42 which is constructed from a suitable refractory material and which is mounted to the wall of the steam boiler 44 surrounding a burner inlet opening 46. A tubular burner nozzle 48 extends from an outer wall 50 into the combustion chamber 52. Coal from the pulverizing mill is suspended in an air stream and enters the burner nozzle 48 through elbow fitting 54 attached to its outer end and then emerges from the nozzle into the combustion chamber 52. A flow diverter 56 is mounted ahead of the burner nozzle 48 on a rod 58 for distributing the pulverized coal-air stream in a widely dispersed pattern as it emerges from the nozzle 48. The flow diverter 56 may consist of a plurality of inclined baffles on a circular frame, for instance. The flow pattern may be adjusted by movement of the rod 58 which is supported on a spider 60 inside the nozzle 48 and through a cover plate 62 on elbow fitting 54. Auxiliary pre-heated air from the steam boiler passes through a multiplicity of adjustable vanes 64 surrounding the burner nozzle 48 and mixes with the pulverized coal-air stream in the combustion chamber 52.

Mounted in the outer wall 50 of the steam boiler is the electric arc igniter torch T. The torch T, which is of basically the same construction as that shown in FIG. 2, is arranged such that its nozzle electrode is placed in close proximity to the combustion chamber 52. In operation, the pulverized coal is ignited through spontaneous combustion by the hot high velocity igniter gas jet effluent emitted from the torch T as the coal emerges from the burner nozzle 48. Optionally, the torch T is continuously operated once ignition occurs in order to stabilize the coal-air flame and to prevent the flame from being extinguished.

Although the present invention has been described herein with particular reference to a circular type coal burner, it will of course be understood that the present invention is not limited thereto and that electric arc heating devices can be used to ignite pulverized coal in other types of coal burners well known in the art. For instance, electric arc heating devices of the type described can be incorporated as well in the coal burners of conventional tangential-fired steam boilers.

A significant feature of the present invention resides in the use of a high voltage, vortex stabilized, electric arc heating device as the igniter torch. The use of this type of arc heating device is highly beneficial since the high voltage torch exhibits high arc voltage and low arc current at a given power level. With low arc current, igniter operating costs are less because the electrode wear rate is low (i.e., electrode wear rate is proportional to arc current raised to a power substantially greater than 1). Furthermore, equipment operating costs are reduced because arc torch efficiency, i.e. the ratio of power in the gas jet to power input, is inversely proportional to arc current. At low arc current, more input power is consumed in the gas jet and less input power is wasted in the coolant.

Spontaneous combustion of pulverized coal in air takes place basically in the following manner: As the coal particles are heated to an elevated temperature the volatile material leaves the particle surface and begins to burn. Subsequently, as the temperature further increases, combustion of the remaining material occurs. Pulverized coal exhibits spontaneous combustion in accord with this process when heated to temperatures above 500° F.

It has been determined experimentally that ignition of pulverized coal will occur in accordance with the practice of the present invention when certain minimum conditions are met. Thus, it has been found that coal ignition with air as the igniter gas will occur when a dimensionless parameter "*f*" defined by the following equation equals or exceeds a minimum value of between about 0.70 and 0.80

$$f = \frac{P_{gas}\, e^{\left(\frac{h}{5630}\right)} - 3.7\, w_{pa}}{79(3 + w_c)} + e^{\left(-3.65 \frac{w_c}{w_{pa}}\right)} - e^{\left(-7.3 \frac{w_c}{w_{pa}}\right)}$$

where $P_{gas}$ = the power in the arc heated air igniter effluent (KW)

$h$ = the bulk total enthalpy of the igniter effluent (BTU/lb)

$w_{pa}$ = the primary air flow rate through the pulverized coal burner (lb/sec)

$w_c$ = the coal flow rate through the pulverized coal burner (lb/sec)

The following example further illustrates the practice of the present invention.

EXAMPLE

A high voltage, vortex stabilized arc igniter torch was installed in one of the coal burners of an operational 800 MW coal-fired, suspension type steam boiler. The coal buner was a 12-inch circular coal burner of nominal 20 MW thermal rating. Ignition tests were performed at six separate conditions. The test procedures were as follows. In the first, second and third tests the coal mill was started with the igniter in operation, then the coal feeder was started, and the total mill output flowed through the burner. When ignition was not observed, the feeder was turned off and the mill was allowed to sweep out. The boiler was purged between each test. In the fourth, fifth and sixth tests the same procedure was followed except that coal from the mill was allowed to flow through an adjacent burner as well. Ignition occurred on the fifth and sixth tests.

Test results are summarized in the table below:

| Test No. | $P_{gas}$ | h | $w_c$ | $w_{pa}$* | f | Result |
|---|---|---|---|---|---|---|
| 1 | 52 | 4630 | 2.5 | 11 | 0.424 | No ignition |
| 2 | 72 | 5100 | 2.5 | 11 | 0.562 | No ignition |
| 3 | 92 | 3440 | 2.5 | 11 | 0.538 | No ignition |
| 4 | 56 | 5980 | 1.1 | 4.74 | 0.690 | No ignition |
| 5 | 56 | 5980 | 0.97 | 4.74 | 0.709 | Ignition |
| 6 | 56 | 5980 | 0.87 | 4.74 | 0.721 | Ignition |

*Primary air was at ambient temperature of 91° F.

The coal burner on which the above ignition tests were performed had a nominal thermal rating of 20 megawatts and was normally ignited with a torch using natural gas fuel which supplied a thermal output of 380 kilowatts (1.9% of 20 MW thermal rating). The arc heated igniter accomplished ignition with air at a thermal output of 56 kilowatts (0.28% of 20 megawatt thermal rating). This of course represents a significant improvement.

What is claimed is:

1. Method of igniting pulverized coal suspended in an air stream comprising introducing an igniter gas selected from the group consisting of air, oxygen, mixtures of air and oxygen or mixtures of air or oxygen with other oxidizing, non-combustible or inert gases under pressure into a gas chamber having an exit nozzle, creating a vortex flow of said igniter gas through said gas chamber, establishing an electric arc between a pair of electrodes inside said gas chamber to heat the igniter gas to extremely high temperatures whereupon the gas emerges from said chamber through said exit nozzle in the form of a high velocity igniter gas jet composed predominantly of highly chemically active, ionized and dissociated species of said igniter gas, the temperature of said high velocity gas jet being in the range of from about 5,200° to about 15,000° F, and directing said igniter gas jet into contact with the pulverized coal-air stream to ignite the coal through spontaneous combustion.

2. The method in accordance with claim 1 wherein the hot high velocity igniter gas jet is maintained in contact with the pulverized coal-air stream after ignition occurs in order to stabilize the coal-air flame and prevent the flame from being extinguished.

3. The method in accordance with claim 1 wherein an auxiliary stream of preheated air is mixed with the pulverized coal-air stream.

4. Method of igniting pulverized coal in a coal burner wherein the pulverized coal is suspended in an air stream while passing through said coal burner, comprising introducing air under pressure into a gas chamber having an exit nozzle, establishing an electric arc from a high voltage power supply between a pair of electrodes to heat the air introduced into said chamber to extremely high temperatures whereupon the heated air emerges from said chamber through said exit nozzle in the form of a hot high velocity air jet, and directing the hot high velocity air jet into contact with the pulverized coal-air stream while maintaining the flow rate of both the pulverized coal and air stream, the power in the hot high velocity air jet and the bulk total enthalpy thereof at predetermined values such that the dimensionless parameter "$f$" in the following equation equals or exceeds a minimum value within the range of between about 0.70 and 0.80

$$f = \frac{P_{gas}\, e^{\left(\frac{h}{5630}\right)} - 3.7\, w_{pa}}{79(3 + w_c)} + e^{\left(-3.65 \frac{w_c}{w_{pa}}\right)} - e^{\left(-7.3 \frac{w_c}{w_{pa}}\right)}$$

where $P_{gas}$ = the power in the hot high velocity air jet expressed in kilowatts $h$ = the bulk total enthalpy of the hot high velocity air jet expressed in BTU per pound $w_{pa}$ = the air flow rate through said coal burner expressed in pounds per second $w_c$ = the coal flow rate through said coal burner expressed in pounds per second.

* * * * *